United States Patent [19]

Castro et al.

[11] 4,020,787

[45] May 3, 1977

[54] VISUAL ALTITUDE ALERTING INDICATOR

[75] Inventors: Raoul Castro, Winfield; Herbert H. Kleist, Oak Lawn; Louis O. Meredith, Orland Park, all of Ill.

[73] Assignee: Diversified Interests Inc., Orland Park, Ill.

[22] Filed: Nov. 21, 1975

[21] Appl. No.: 634,037

[52] U.S. Cl. ..... 116/129 K; 73/178 T; 116/129 F

[51] Int. Cl.[2] ..... G09F 9/00

[58] Field of Search ..... 116/129 F, 129 K, 129 R, 116/133, 131; 73/386, 387, 384, 178 T

[56] References Cited

UNITED STATES PATENTS

| | | | |
|---|---|---|---|
| 2,002,874 | 5/1935 | Urfer | 73/387 |
| 2,325,282 | 7/1943 | Schwenn | 73/387 |
| 2,943,597 | 7/1960 | Coffing | 116/133 |
| 3,045,638 | 7/1962 | Davio | 116/129 R |

FOREIGN PATENTS OR APPLICATIONS

| | | | |
|---|---|---|---|
| 317,521 | 1/1957 | Switzerland | 116/129 |

*Primary Examiner*—S. Clement Swisher
*Assistant Examiner*—Denis E. Corr
*Attorney, Agent, or Firm*—Hill, Gross, Simpson, Van Santen, Steadman, Chiara & Simpson

[57] ABSTRACT

Visual altitude alerting indicator for the altimeter of an aircraft, manually settable at "Before Landing Check List" to alert the pilot through visual cues to the required safe altitudes he must remember to prevent flying below prescribed safe altitudes, and to the altitude where the pilot must apply power to level when landing. The indicator requires no electronic assistance or audio alarms that might confuse the pilot over the many audio alarms presently used on aircraft. The alerting indicator consists of a ring concentric with the pivot for the hands of the altimeter and center of the dial therefor and adjustably movable about the dial and has a series of indicating altitude pointers to be adjusted relative to the dial at "Before Landing Check List" to alert the pilot through visual cues to the altitude he has to remember to prevent flying below prescribed safe altitudes when landing.

8 Claims, 3 Drawing Figures

VISUAL ALTITUDE ALERTING INDICATOR

FIELD OF THE INVENTION

Visual alerting means for altimeters for aircraft adjustable relative to the dial of the altimeter at "Before Landing Check List" to alert the pilot to the altitude to be maintained to prevent flying below prescribed safe altitudes in preparation for landing.

PRIOR ART, BACKGROUND, SUMMARY AND ADVANTAGES OF INVENTION

Adjustable dials have been commonly provided on pressure gauges to correct for defects in the indications of the gauge, as shown in the Annin U.S. Pat. No. 140,867, dated July 15, 1873 and in the U.S. Pat. No. 1,397,518 to hem. Other patents relate to aircraft gauges, as for example, the Fragola et al U.S. Pat. Nos. 2,700,898; Milligan 2,750,917; Davio 3,045,638; Kurowski 3,115,863 and Canning et al. 3,621,210. While these patents show pointers traversing the scale markings of the gauge or altimeter, they do not disclose the principle of visually alerting the pilot to the altitudes he has to maintain and remember to prevent flying below prescribed safe altitudes in preparation for landing.

The present invention comprises a standard altimeter having a ring adjustable about the dial of the altimeter with pointers extending inwardly therefrom, adjustable at Before Landing Check List to remind the copilot to make call-outs at, for example, 500 feet above "decision height", 200 feet above decision height, 100 feet above decision height and at decision height and alerting the pilot to apply power to level at decision height. The alerting indicator is so designed as to fit all standard altimeters used on aircraft and requires no tools to install, does not obstruct instrument readings and sets to indicate a plurality of altitude positions which may be in the order of four altitude positions, but which may vary as conditions vary.

An advantage of the present invention is that a simple addition to the altimeter of an aircraft is provided which is adjustable to alert the pilot through visual cues to the altitudes to be remembered to prevent flying below prescribed safe altitudes.

A further advantage of the invention is that the altitude alerting indicator requires no electronic assistance or audio alarms that might confuse the pilot over the many audio alarms presently used on aircraft.

A further advantage of the invention is that the alerting indicator is easy to install and adjust, requires no tools to adjust and does not obstruct instrument readings in setting to indicate a plurality of altitude indicating positions critical for landing.

A still further advantage of the invention is that the altitude alerting indicator fits all standard altimeters and thus is universally adaptable to practically all aircraft presently in use.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure.

DESCRIPTION OF THE PREFERRED EMBODIMENT

Figure 1:
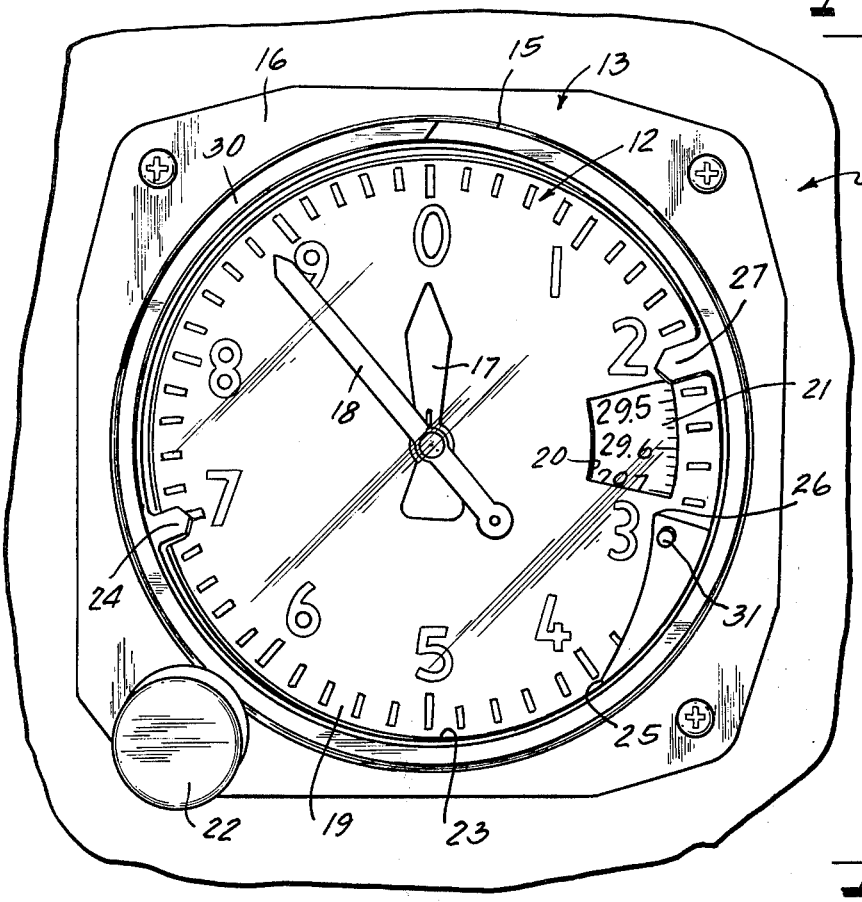
FIG. 1 is a plan view of an altimeter with an altitude alerting indicator constructed in accordance with the principles of the present invention applied thereto, for adjustment relative to the dial of the altimeter.
Figure 3:
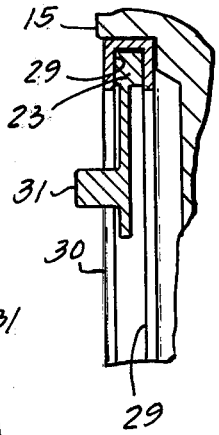
FIG. 3 is an enlarged fragmentary sectional view indicating a portion of the alerting indicator mounted in the casing of an altimeter.
Figure 2:
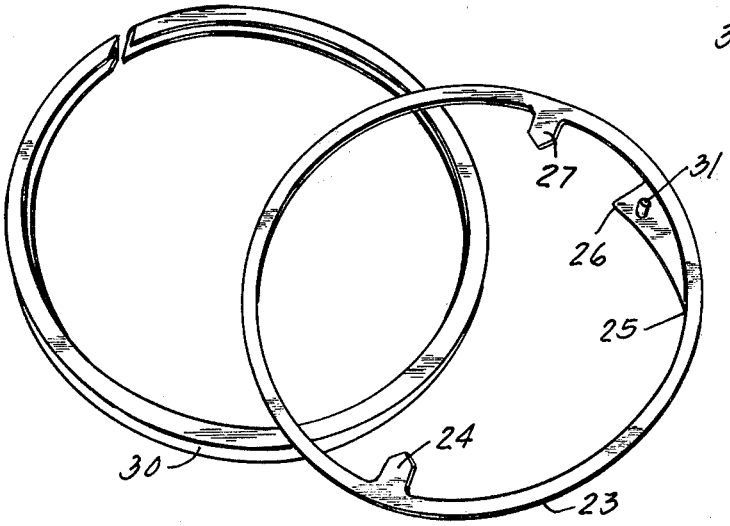
FIG. 2 is an exploded view illustrating the altitude alerting indicator and the mounting ring therefor, rotatably mounting the alerting indicator for adjustment about the dial of the altimeter and coaxial with the axis of the altitude indicating hands of the altimeter.

In the embodiment of the invention illustrated in the drawings, we have shown a fragment of an instrument panel 10 for aircraft having an altimeter 12 of a conventional form mounted thereon. The altimeter 12 includes a casing 13 having an annular flange 15 extending thereabout axially of a mounting flange 16 of the altimeter, and coaxial with the axis of altitude indicating hands 17 and 18. The indicating hands 17 and 18 are pivotally movable about a dial 19 for the altimeter and graduated in hundreds of feet from 0 to 1,000 feet, the small hand 17 indicating thousands of feet. The large hand 18 indicates hundreds of feet.

The dial 19 has a window 20 therein opening to graduations 21 of barometric pressure. The altimeter is adjusted in accordance with the barometric pressure by a knob 22 in a conventional manner, which is no part of the present invention so need not herein be shown or described further.

Referring now in particular to the visual altitude alerting indicator of our invention, an indicator ring 23, concentric with the axis of the hands 17 and 18, is provided for adjustable movement about the dial and has four altitude alerting positions or indicators 24, 25, 26 and 27, spaced thereabout, to be set at Before Landing Check List and remind the copilot to make call-outs at one height above decision height which, for example, may be 500 feet, another lower height above decision height which may be 200 feet, a third height which may be 100 feet above decision height, and a fourth height which may be decision height, at which time power is applied to level the plane for landing. The indicators 24, 25, 26 and 27 may be of different colors to aid in alerting the pilot and copilot to the critical heights prior to landing, as for example, the indicator 24 may be white, the indicators 25 and 26 may be green, the indicator 25 being at the start of an arc at the internal periphery of the ring 23, struck about an axis offset from the axis of the hands 17 and 18 and terminating at a peak to define the indicator 26. The indicator 27 may be red and may be a pointer or arrow extending radially inwardly of the ring 23 and shown as being spaced 180° from the indicator 24, although this spacing may be varied for different indicators in accordance with prescribed safe landing decision heights.

The indicator ring 23 is rotatably carried in a channel 29 of a resilient split spring ring 30, for rotatable movement with respect to said split ring. The split ring 30 may be made of a plastic or other resilient material having a tendency to expand, and expanded by the elasticity of the material to receive the indicator ring 23 in the channel 29, and contracting about said indicator ring when placed within the axial flange 15 of the casing 13, but retaining said indicator ring within the axial flange 15 for rotatable movement relative thereto.

The indicator 26 is generally triangular in form with two sides formed by arcs struck from different centers, and has a pin 31 projecting outwardly of the sector or triangle adjacent the indicator 26, and affording a means for adjusting and setting the indicator to indicate at least four altitude alerting positions at Before Landing Check List.

It thus may be seen that the altitude alerting indicator of the present invention may readily be inserted in the altimeters of aircraft without the use of tools and is not only easy to install, but may readily be adjusted to remind a crew member to call-out critical heights at, for example, 500 feet above decision height, 200 feet above decision height, 100 feet above decision height and at decision height and alert the pilot to apply power to level at decision height which may be an altitude of 200 feet above the ground.

It should be understood, however, that while we specify certain decision heights for a crew member to make call-outs and to alert the pilot through visual cues to altitudes necessary to prevent flying below prescribed safe altitudes, that the decision heights may be varied from those mentioned herein and the variations in decision heights may be attained by varying the spacing between the alerting indicators.

It should further be understood that the visual altitude alerting indicator of the invention fits all aircraft altimeters and requires no electronic assistance or audio alarms that would tend to confuse the pilot with the many audio alarms presently used to alert the pilot to various conditions, while flying the aircraft, and does not obstruct instrument readings.

We claim as our invention:

1. In a visual preparatory landing altitude alerting indicator for aircraft and the like and in combination with an altimeter having hands movable thereabout to indicate the altitude of the aircraft, and a rim, visual altitude alerting means for said altimeter and cooperating with said hands to alert the pilot through visual cues of the altitudes that must be maintained to prevent flying below prescribed safe altitudes in preparation for landing comprising a series of circumferentially spaced alerting indicators, means adjustably mounting said alerting indicators for rotatable movement about the rim of the altimeter, and accommodating said alerting indicators to be set to indicate a plurality of critical altitude positions in preparation for landing, and to be adjusted at Before Landing Check List, to remind a crew member to make call-outs at a first predetermined altitude above landing decision height, a second predetermined lower altitude above decision height, a third predetermined lower altitude above decision height and alerting the pilot to apply power to level the aircraft at decision height, including a ring having a plurality of said alerting indicators spaced thereabout, and an annular support forming a bearing mounting for said ring, accommodating the adjustment of said ring about said support, said alerting indicators being spaced about said ring in accordance with the altitudes to be called out for landing and extending inwardly of said ring and the bearing mounting for said ring being a yieldable expansible and contractible ring fitting within the altimeter and held thereto by the expansibility of said ring fitting.

2. The visual altitude alerting indicator of claim 1 in which the bearing support for said ring is in the form of a split ring.

3. The visual altitude alerting indicator of claim 2 in which the altimeter includes a dial, with said hands movable about said dial about a fixed axis to indicate the altitude in hundreds and thousands of feet, in which the altimeter has a casing having an internal cylindrical wall extending axially of the dial, in which the bearing and support split spring is mounted within said internal cylindrical wall and resiliently engaged therewith and forms a track for said altitude alerting indicators, and accommodates said altitude alerting indicators to be adjustably moved about said dial to alert the pilot and copilot to prescribed minimum decision heights in preparation for landing.

4. The altitude alerting indicator of claim 3 in which the resilient split ring is channel-like in cross section and opens toward the center of the dial throughout the circumference thereof.

5. The visual altitude alerting indicator of claim 4 in which the alerting indicator includes an indicating ring having two diametrically spaced indicators extending radially inwardly of said ring, an intermediate indicator between said two indicators, in predetermined spaced relation with respect to said diametrically spaced indicators and having a sloping approach sloping inwardly of the inner periphery of said indicator ring, the entering end of said sloping approach indicating decision heights above the decision height of said intermediate indicator and said intermediate indicator indicating a lower decision height.

6. The visual altitude alerting indicator of claim 5, including a pin extending axially outwardly of said intermediate indicator between said first-mentioned alerting indicators and forming an adjustment means for the altimeter, adjusting the altimeter in accordance with required decision heights for landing, prior to the landing check list.

7. The visual altitude alerting indicator of claim 1 in which the expansible and contractible ring fitting has an inwardly opening channel extending thereabout and forming a bearing mounting for said alerting indicators.

8. The visual altitude alerting indicator of claim 7 in which the alerting indicators are all in fixed relation with respect to each other and extend inwardly of the ring forming the support for said altitude alerting indicators.

* * * * *